US011478112B2

(12) United States Patent
Young

(10) Patent No.: US 11,478,112 B2
(45) Date of Patent: Oct. 25, 2022

(54) WATER RESISTANT ROLL MATERIAL DISPENSER ASSEMBLY AND KIT

(71) Applicant: San Jamar, Inc., Elkhorn, WI (US)

(72) Inventor: Michael Young, Mukwonago, WI (US)

(73) Assignee: San Jamar, Inc., Elkhorn, WI (US)

( * ) Notice: Subject to any disclaimer, the term of this patent is extended or adjusted under 35 U.S.C. 154(b) by 262 days.

(21) Appl. No.: 16/829,518

(22) Filed: Mar. 25, 2020

(65) Prior Publication Data

US 2021/0298542 A1 Sep. 30, 2021

(51) Int. Cl.
*A47K 10/38* (2006.01)
*B65H 16/00* (2006.01)

(52) U.S. Cl.
CPC ..... *A47K 10/38* (2013.01); *B65H 16/005* (2013.01)

(58) Field of Classification Search
None
See application file for complete search history.

(56) References Cited

U.S. PATENT DOCUMENTS 4,307,638 A * 12/1981 DeLuca ..... A47K 10/3643 83/345
5,273,184 A 12/1993 Rizzuto
5,294,192 A * 3/1994 Omdoll ..... A47K 10/3687 242/564.4
5,706,986 A 1/1998 Brandenburg et al.
5,803,373 A 9/1998 Sedlock, Jr. et al.
6,131,773 A * 10/2000 Wade ..... A47K 5/1215 222/153.09
7,387,274 B2 6/2008 Moody et al.
8,322,568 B2 12/2012 Cattacin et al.

FOREIGN PATENT DOCUMENTS

EP 0109343 A1 5/1984
EP 1230886 A1 8/2002
EP 1659691 A2 5/2006
WO WO 2005/006931 * 1/2005

* cited by examiner

*Primary Examiner* — William A. Rivera
(74) *Attorney, Agent, or Firm* — Boyle Fredrickson S.C.

(57) ABSTRACT

An assembly, kit, and method for water-proofing a rolled web material dispenser. The assembly includes a mounting plate that is constructed to engage a back surface of a housing of the web material dispenser and includes a gasket that is disposed between a front surface of the mounting plate and the back surface of the housing to form a water-tight seal therebetween. A plurality of ribs extend in a rearward direction towards a mounting surface from a back surface of the mounting plate and define a plurality of channels that guide water sprayed above the dispenser away from a cavity enclosed by the housing. The assembly preferably includes a plug that is preferably tethered to the mounting plate and is constructed to cooperate with a keyhole of the dispenser housing and form a watertight seal therewith.

19 Claims, 9 Drawing Sheets

WATER RESISTANT ROLL MATERIAL DISPENSER ASSEMBLY AND KIT

BACKGROUND OF THE INVENTION

The present invention generally relates to rolled web material dispenser assemblies and, more specifically, is directed to an assembly, kit, and method for waterproofing rolled web material dispenser assemblies.

Dispensers for dispensing discrete portions of paper or web material from bulk rolls of such materials have been employed for many years and across various industries and for various applications. Such dispensers are widely used in public lavatories to dispense paper toweling for users to dry their hands. Typically, a bulk roll of sheet material is supported within a dispenser cabinet or housing and incrementally rotationally advanced to dispense discrete portions of the bulk material roll. In manually operated devices, manual actuation of a button or lever effectuates operation of a feed mechanism configured to rotationally advance the bulk roll and dispense a tail end of the sheet material beyond the confines of the cabinet or housing for use by the user. The feed mechanism typically includes a drive roller and an idle roller. The manually actuated lever interacts with the drive roller so that actuation of the lever rotates the drive roller. Rotation of the drive roller acts to unwind material from the material roll.

Alternative dispensers, which eliminate or limit manual operation of the roll material dispensing systems, are often referred to as "contactless" or "touchless" dispensers. Such dispensers commonly use one or more proximity sensors that detect the presence of a hand of other part of a user relative to the dispenser and include a motorized feed assembly that advances the feed mechanism to effectuate dispensing of the sheet material from the housing.

Dispensers for rolls of flexible sheet material, whether manually operated, operated in the touchless manner, or a combination thereof, when deployed in industrial or commercial environments, are often located in environments that require periodic wash down cleaning That is to say, unlike many restroom applications, some applications associated with the use of such rolled web material dispensers require placement of the dispensers in areas that are subject to spray or wash downs associated with cleaning activities by pressurized sprays of detergents, disinfectants, water, and/or other fluids. During the wash-down procedure, liquid may penetrate the housing of the roll towel dispenser.

The ingress of water and other fluids presents concerns associated with the destruction or soiling of entire remaining bulk volume of the roll of flexible sheet material, i.e., hand towel, that is located within the housing. Ingress of fluids also has the potential of interfering with or damaging the structures associated with the feed activity. Such concerns can be compounded in those dispenser assemblies that include internal electronic components such as circuit boards, switches, motors, and/or the like common to touchless rolled web material dispenser assemblies. The ingress of fluid can result in the premature replacement of the unused portion of spoiled rolls of flexible sheet material and/or rendering the dispenser inoperable. Replacement of spoiled rolls of web material is both a time consuming and wasteful side effect associated with washdown cleaning of a facility having one of more wall mounted rolled web material dispensers.

In an effort to mitigate the detriments of such events, many users elect to remove the dispenser assembly from the environment prior to execution of the washdown activity and subsequent replacement of the dispenser assembly thereafter. The repeated removal and replacement of the dispenser assemblies during each washdown activity is time consuming, detracts for the efficiency associated with execution of the washdown, and can result in malfunction and/or damage to the dispenser assembly if not handled in an appropriate manner during the repetitive removal and remounting thereof. The frequency with which washdown events are required within a particular facility or environment tends to exacerbate or compound these concerns.

Although feasible to provide a rolled web material dispenser having a generally watertight construction, such an approach presents additional considerations. Rolled web material dispensers are provided in a litany of constructions that are frequently to satisfy the user's esthetic requirements as well as various requirements associated with the material intended to be dispensed therefrom. Providing dedicated waterproof dispenser enclosures across such a diverse product platform is unfeasible and untenable. Further, the demands of a user and/or governmental regulations may periodically change and result in instances of owned dispensers being rendered no longer compliant or useable for exposure during washdown conditions. Resolving the same can require the unnecessary replacement and/or discarding of previously owned dispensers thereby increasing operating expenses.

Still further, although such dispensers could be constructed to better tolerate washdown events, such an approach leaves the area between the rear of the housing and the wall associated with supporting the dispenser assembly generally uncleanable unless the more water resistant dispenser is removed therefrom. That is, the contacting engagement between the rear of the dispenser assembly and the supporting surface prevents cleaning of the entire area that is rearward of the dispenser. Still further, the rearward facing portion of such dispenser assemblies commonly include multiple perforations associated with manufacturing processes such that the passage of fluid to the area generally behind the dispenser assembly would render such passages available for the undesirable ingress of fluids into the enclosed spaced defined by the housing of the dispenser assembly.

Accordingly, there is a need for an assembly, kit, and method for providing a water-resistant dispenser assembly that allows the dispenser to remain wall mounted during a washdown procedures while maintaining a watertight interior to prevent spoilage of any remaining portion of the bulk roll of web material due to the infiltration of fluid or liquids. There is a further need for a washdown tolerant rolled web material dispenser assembly that is constructed to accommodate cleaning of a majority of the surface area that underlies the dispenser assembly when deployed. There is a further need for a kit that is constructed to cooperate with previously acquired rolled web material dispenser and improves the ability of the dispenser to resist ingress of fluids and to facilitate cleaning of the areas generally behind the previously deployed dispenser.

SUMMARY OF THE INVENTION

The present invention discloses a water-resistant dispenser assembly that resolves one or more of the shortcomings disclosed above.

One aspect of the present application discloses a water-resistant dispenser assembly that includes an enclosure configured to hold a roll of web material, the enclosure having an opening through which the web material is dispensed and a mounting plate that is constructed to cooperate with a back surface of the enclosure. A gasket is disposed between a front surface of the mounting plate and the back surface of the enclosure to form a watertight seal therebetween. A plurality of ribs extend rearwardly from a back surface of the mounting plate towards a mounting surface, such as a wall or similar generally vertical structure, and define a number of channels and offset the rearward facing surface of the enclosure of the dispenser assembly from the support surface to accommodate washdown of surfaces rearward of the dispenser assembly without requiring removal of the same.

Another aspect of the present application usable or combinable with one or more of the above aspects discloses a plurality of fluid channels defined between each pair of adjacent ribs, the back surface of the mounting plate, and the mounting surface.

Another aspect of the present application usable or combinable with one or more of the aspects disclosed above includes a plurality of watertight threaded slots in the mounting plate, each configured to receive a threaded fastener passing through the back surface of the enclosure.

Still another aspect of the present application usable or combinable with one or more of the aspects disclosed above includes a plug that is preferably tethered to the mounting plate and is configured to form a watertight seal with a keyhole defined by an outer surface of the enclosure of the dispenser assembly.

Another aspect of the present application that is usable or combinable with one or more of the above aspects discloses a kit configured to render a rolled web material dispenser assembly water resistant. The kit includes a mounting plate that is configured to be affixed to a back surface of an enclosure of the dispenser assembly and a wall. A gasket is disposed about a perimeter of a front surface of the mounting plate and is configured to form a watertight seal with the back or rearward facing surface of the enclosure. A plurality of ribs extend in a rearward direction from a back surface of the mounting plate toward the wall.

Another aspect of the present application that is usable or combinable with one or more of the above aspects includes a method of installing and using a water-resistant dispenser assembly.

These and other aspects, features, and advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
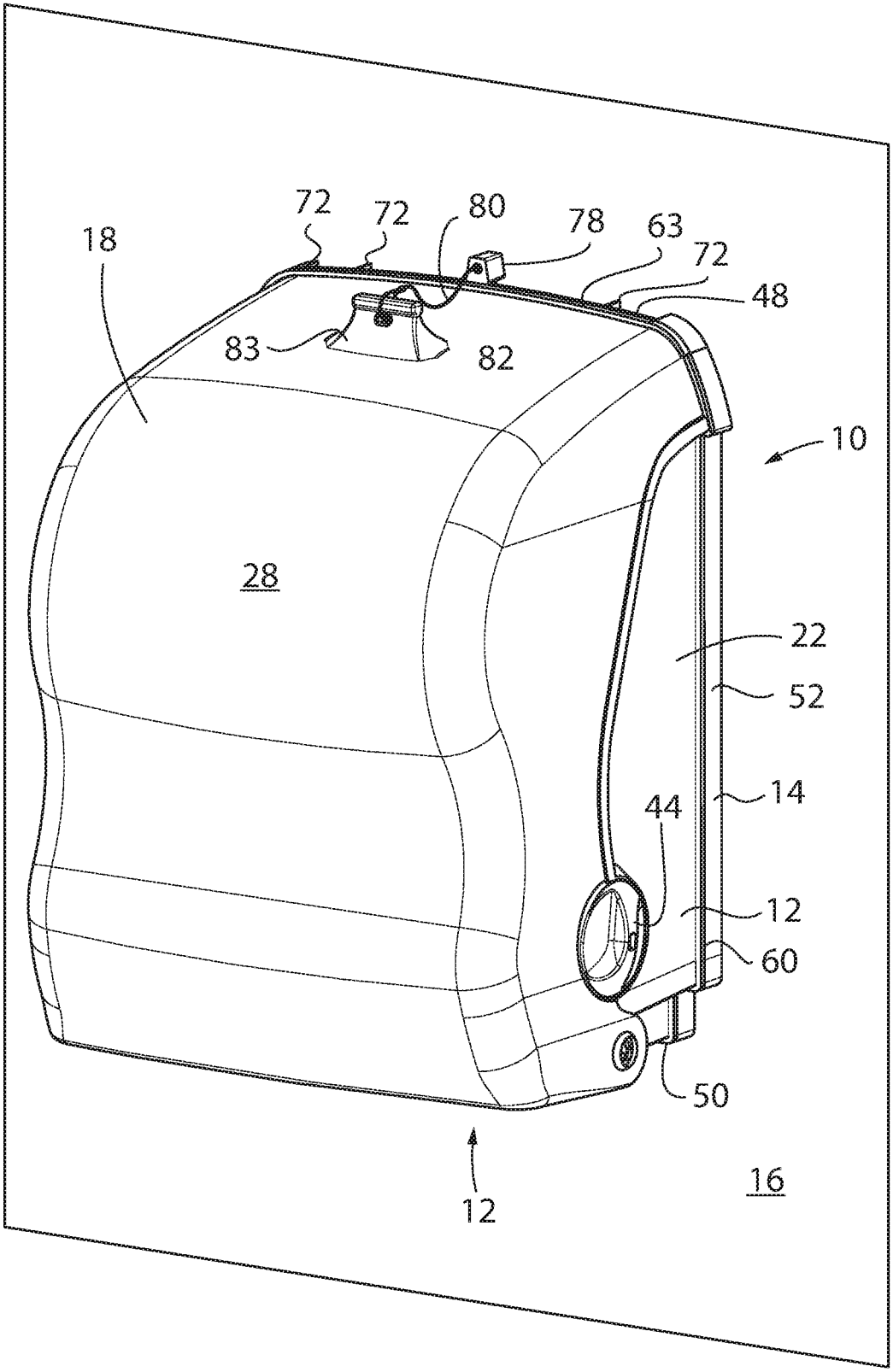
FIG. 1 is a perspective view of a water-resistant dispenser assembly according to the present invention.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. The various features and advantageous details of the subject matter disclosed herein are explained more fully with reference to the non-limiting embodiments described in detail in the following description.

Illustrative embodiments of a water-resistant dispenser assembly 10 in accordance with various aspects of the present invention are shown in FIG. 1 through FIG. 9. Initially, FIG. 1 shows a water resistant dispenser mount assembly 10 that includes a rolled web material dispenser 12, according to one embodiment of the present invention. As explained further below with respect to FIGS. 3-8, mount assembly 10 includes a mount, mount plate, or wall mounting plate 14 that is configured to be mounted to a wall 16 or similar generally vertical surface and engage the rear surface of the material dispenser 12 in a water tight configuration, as described in more detail below.

Figure 2:
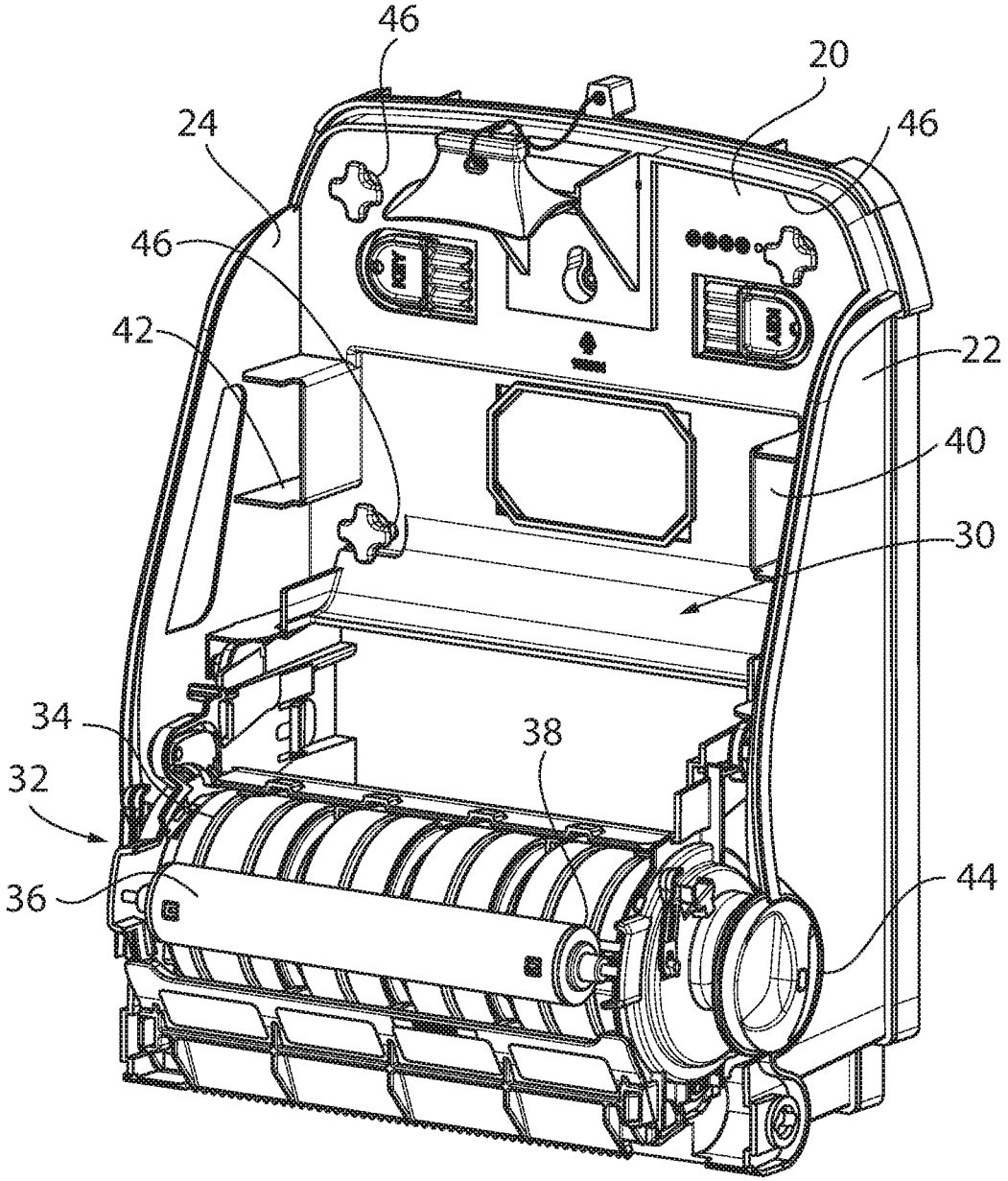
FIG. 2 is a perspective view of the water-resistant dispenser assembly shown in FIG. 1 with a cover of the dispenser assembly removed therefrom.
Figure 3:
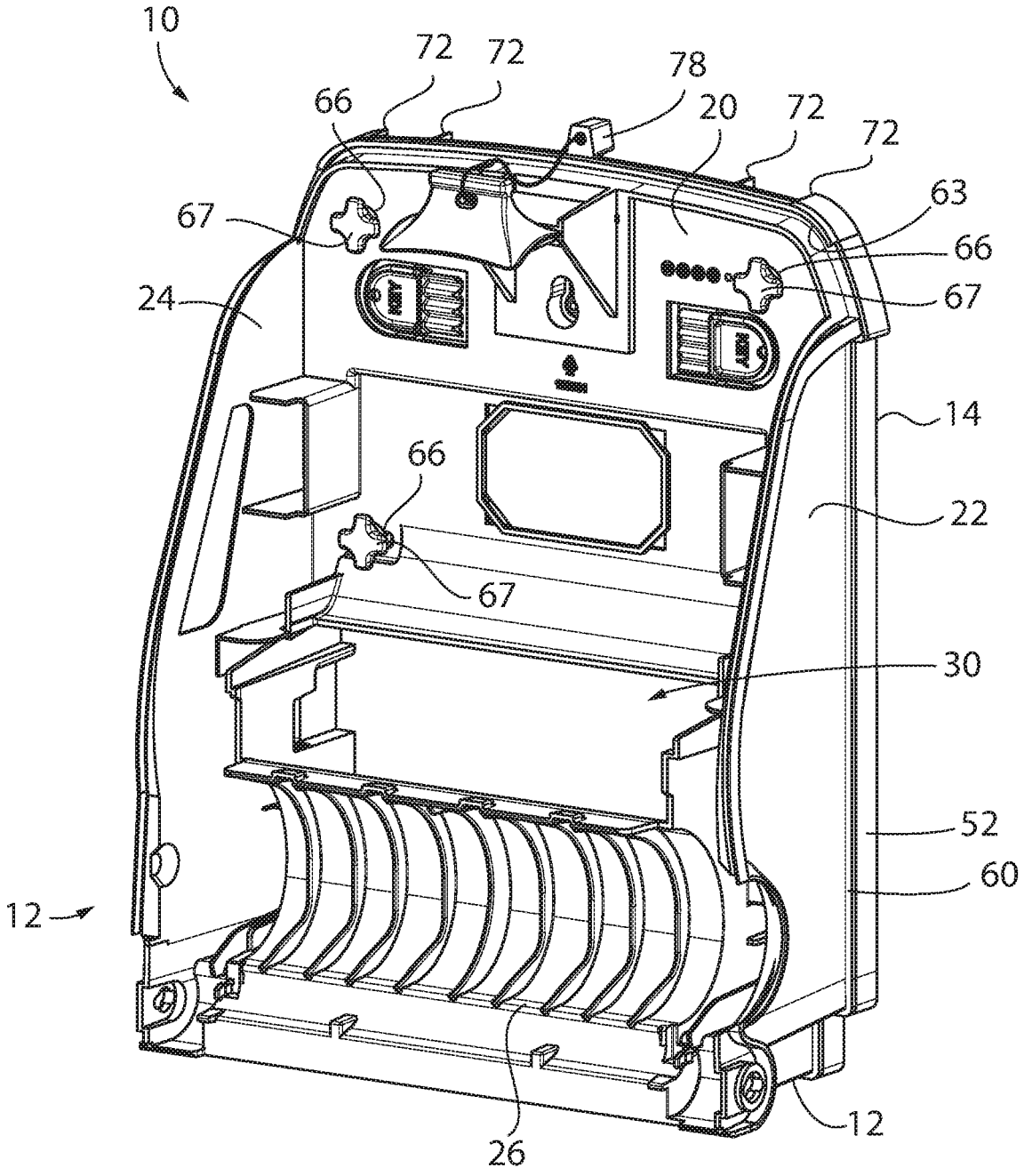
FIG. 3 is a perspective view of the water-resistant dispenser assembly of FIG. 1 with the cover and a feed mechanism removed therefrom and exposing an interior surface of the base of the housing or enclosure of the dispenser assembly.

Referring to FIGS. 1-3, material dispenser 12 includes a cabinet, housing or enclosure 18 that is shaped to receive a replaceable bulk roll of sheet or web material. Enclosure 18 is defined by a base, back, or back wall 20, a first sidewall 22, a second sidewall 24 a floor 26 and a front cover 28 that cooperate with one another to define an interior cavity 30 of enclosure 18. Enclosure 18 may be formed of plastic or other suitable material. The back wall 20, sidewalls 22, 24 and floor 26 collectively form a rear portion or base of enclosure 18. Preferably, sidewalls 22, 24, floor 26, and back wall 20 are provided in a unitary single body construction. Cover 28 movably cooperates with the rear or base portion of enclosure 18 to selectively expose cavity 30 and the roll of web material associated therewith. As disclosed above, it is appreciated that the rearward portion of enclosure 18 or that portion that is generally rearward of cover 28 may be formed as a single or multiple piece assembly formed by injection, blow, or roto molding. Alternatively, the various walls or panels that define enclosure 18 may be separately manufactured parts that are connected by fluid proof connection methodologies such as welds, moldings, fasteners, solder, overlapping snap fit connections, or the like.

Referring to FIG. 2, material dispenser 12 includes a feed assembly or feed mechanism 32 that is contained within enclosure 18. Although shown as an assembly that cooperates with enclosure 18, it is appreciated that in other embodiments, the feed mechanism 32 can be provided in the form of a cassette that can be assembled prior to being associated with enclosure 18. Regardless of the specific configuration, feed mechanism 32 includes a drive roller 34 and an idle roller 36. The drive roller 34 and the idle roller 36 form a pressure nip 38 through which the material is drawn prior to being dispensed beyond the confines or perimeter edge of enclosure 18. The drive roller 34 and the idle roller 36 extend transversely with respect to and are supported from the sidewalls 22, 24 of enclosure 18 such that the same are rendered rotatable about respective parallel axes. It will be appreciated that these axes are also generally parallel to the rotational axis of the roll of sheet or web material.

Referring to FIG. 2, the roll of sheet or web material is configured to be retained within the cavity 30 of the enclosure 18, above the feed mechanism 32. For example, a first and second roll retaining arms (not shown) may extend from first and second receiving slots 40, 42 adjacent the first and second side walls 22, 24, respectively. In this configuration, the roll of sheet or web material is suspended above the feed mechanism 32, where an end of the web material extends downwardly for cooperation with the pressure nip 38 and is advanced out of the enclosure 18 though a downwardly directed opening in the enclosure 18 upon activation and rotation of the drive roller 34. In one embodiment of the present invention, where the dispenser is a contactless system, the drive roller 34 is advanced by user activation of a proximity sensor. In another embodiment of the present invention, where the drive roller 34 is advanced by manual activation an actuator 44, such as a wheel or lever may be manually engaged by the user to advance the material through the rollers 34, 36. When provided in such a manner, actuator 44 preferably sealingly cooperates with contours of enclosure 18 located proximate actuator 44 without interfering with the relative rotational cooperation therebetween.

Still referring to FIG. 2, a plurality of mounting holes or apertures 46 are located in the back wall 20 of the enclosure 18. In a conventional installation, the apertures 46 are configured to receive mounting hardware, such as a threaded fastener or peg, therein such that the material dispenser 12 may be affixed to a wall 16. However, in accordance with the present invention and as disclosed further below, apertures 46 are utilized to receive mounting hardware, i.e., threaded fasteners, that affix dispenser 12 to mounting plate 14 of mount assembly 10.

Figure 4:
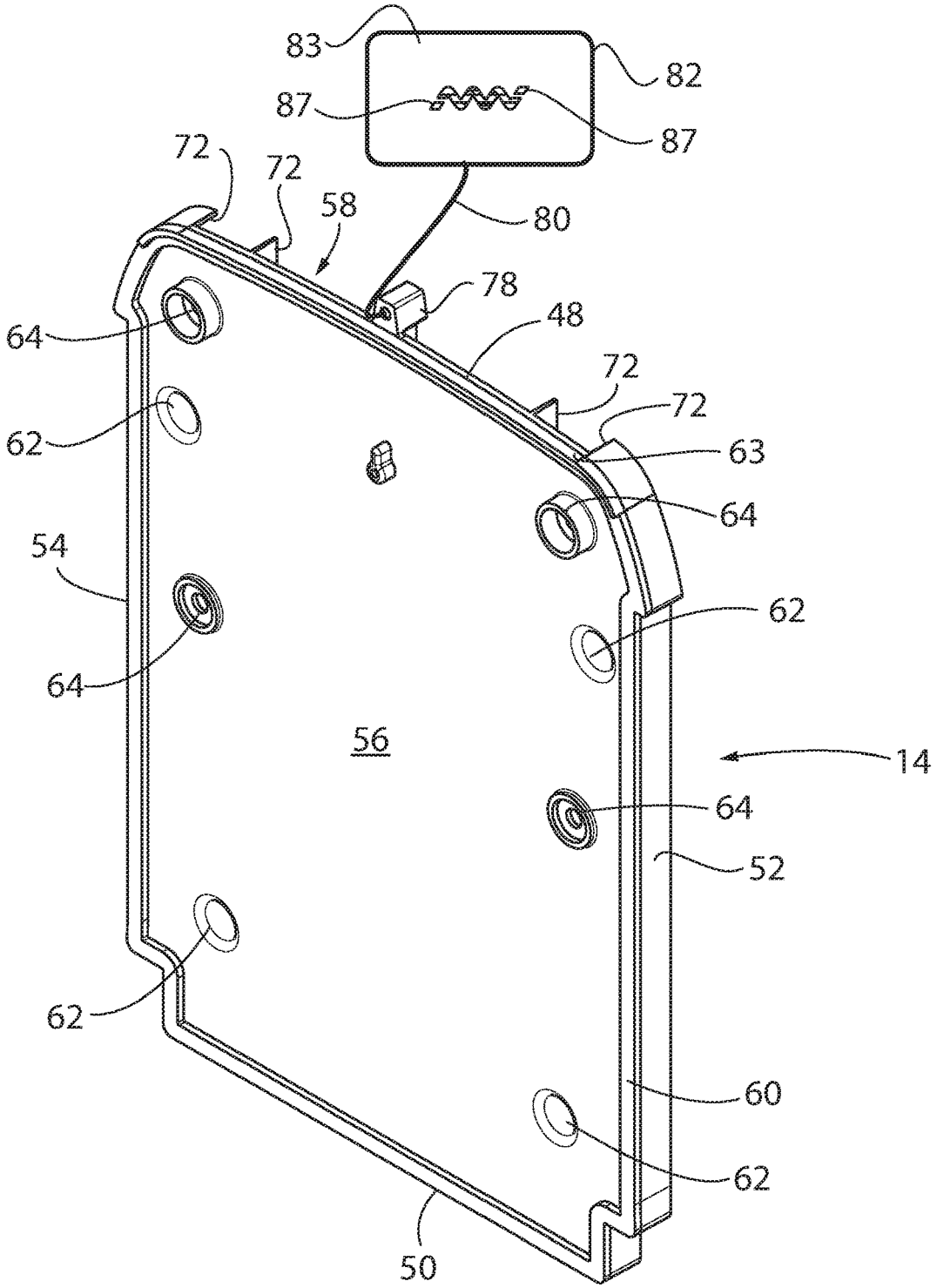
FIG. 4 is a front perspective view of a wall mount plate of the assembly shown in FIG. 1.
Figure 5:
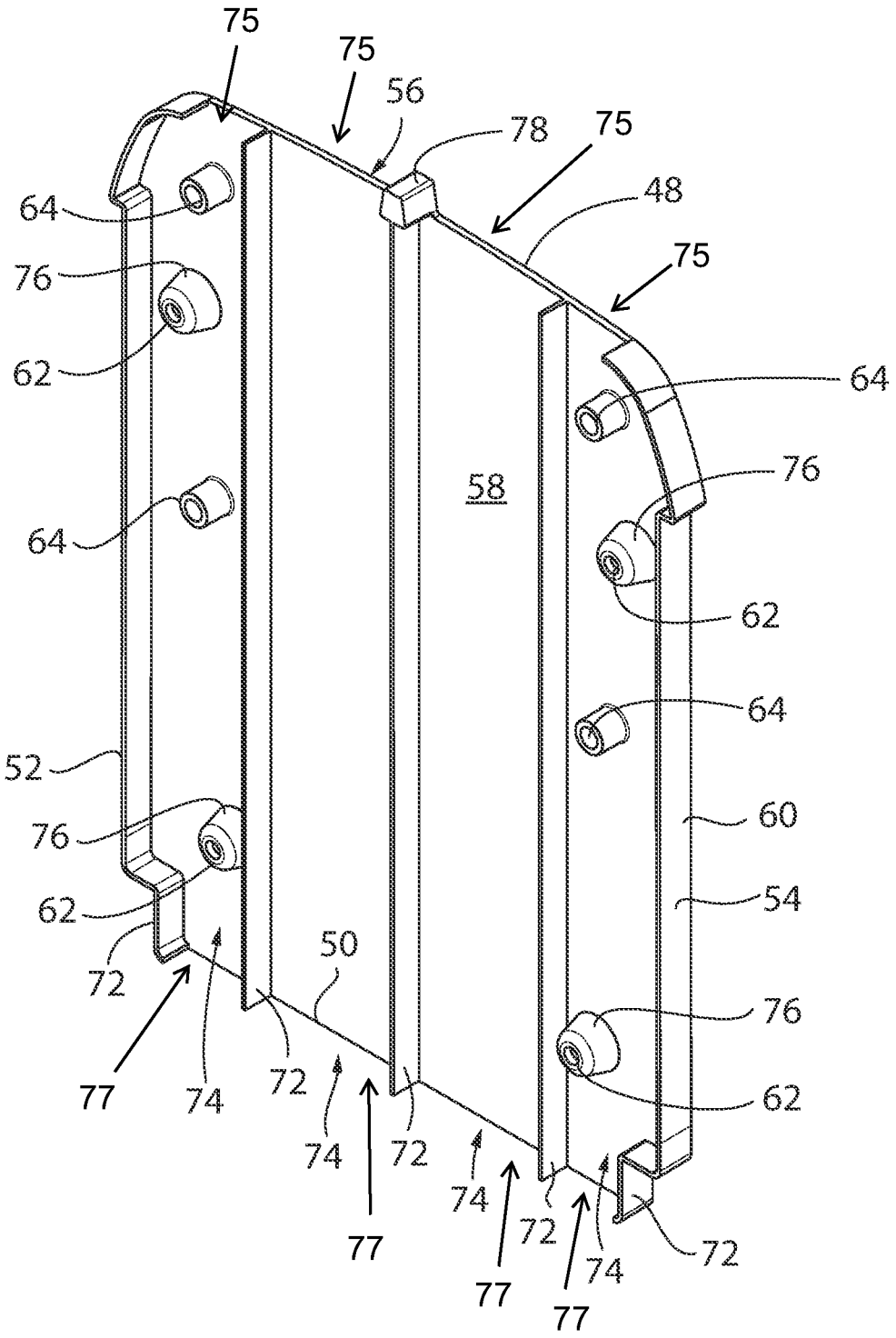
FIG. 5 is a rear perspective view of the wall mount plate shown in FIG. 4.

Turning now to FIGS. 3 through 9, and initially FIGS. 4 and 5, the mounting plate 14 has a top edge 48, bottom edge 50, and first and second opposed side edges 52, 54 extending between respective top and bottom edges 48, 50. A front surface 56 and opposing rear surface 58 of mounting plate 14 extend between edges, 48, 50, 52, 54. The front surface 56 of the mounting plate 14 has a size and shape that generally correlates to and is preferably at least substantially equal to the size and shape of the rear surface of the back wall 20 of the enclosure 18. Accordingly, the mounting plate 14 is configured to possess a perimeter that is generally equal to that of the back wall 20 of the enclosure 18, such that enclosure 18 generally overlies mounting plate 14 when the two are attached to one another as shown in FIG. 3.

In one embodiment of the present invention the perimeter of the front surface 56 of the mounting plate 14, defined by the area bounded by edges 48, 50, 52, 54, includes a seal or gasket 60. The gasket 60 may be formed of a resilient material such as foam, or rubber and is configured to be compressed or otherwise sealingly captured between the front surface 56 of the mounting plate 14 and the back wall 20 of the enclosure 18, when assembled. When compressed, gasket 60 cooperates with the facing surfaces of enclosure 18 and mount plate 14 of mount assembly 10 to prevent the ingress of liquid to the area between the mounting plate 14 and back wall 20 of the enclosure 18 of dispenser assembly 12. The cooperation between mount plate 14 and enclosure 18 also prevents the ingress of fluid into cavity 30 defined by the dispenser housing via apertures 46 associated with the back wall 20. As shown in FIGS. 1, 3, 4, and 9, at least one of mounting plate 14 and gasket 60 includes an overhang, projection, ridge, or lip 63 that extends in a generally forward direction along at least the top edge and preferably at least a portion the side edges defined by mounting plate 14 and/or gasket 60. Lip 63 is oriented to extend over at least the upwardly directed portion of the rearward facing edge of cover 28 when cover 28 is oriented in the closed position and enhances the liquid shedding performance of assemblies 10, 12 when deployed and further mitigates any fluid ingress into dispenser 12 during washdown events.

Referring to FIG. 4, the front surface 56 of the mounting plate 14 of mount assembly 10 further comprises a number of wall mounting apertures 62 and a number of enclosure securing apertures 64. As shown in FIG. 4, in one embodiment, the set of wall mounting apertures 62 includes four apertures that are recessed rearwardly from the front surface 56 of the mounting plate 14. It is appreciated that the number of wall mounting apertures 62 and number of securing apertures may be provided in numbers and orientations other than those which are shown and such modifications are considered within the scope of the claims of the present invention.

A fastener, such as a threaded fastener or screw is configured to pass through each wall mounting aperture 62, and securely engage the wall 16 such that the mounting plate can be rigidly affixed to the wall 16 and configured to support the weight of the dispenser 10 thereon. The set of enclosure securing apertures 64 are disposed within mounting plate 14 of mount assembly 10 at locations that overlie the locations of the apertures 46 in the back wall 20 of the enclosure 18, such that when the enclosure 18 is positioned within the perimeter of the mounting plate 14, the aperture 46 and 64 align. A threaded fastener 66, may then be extend through each of the apertures 46 in the back wall 20 of the enclosure and into its respective aperture 64 in the mounting plate 14, where a water tight threaded slot or socket 68 extending rearwardly from the rear surface 58 of the mounting plate 14 forms a water tight mechanical linkage with the threaded shaft of the fastener 66.

Figure 6:
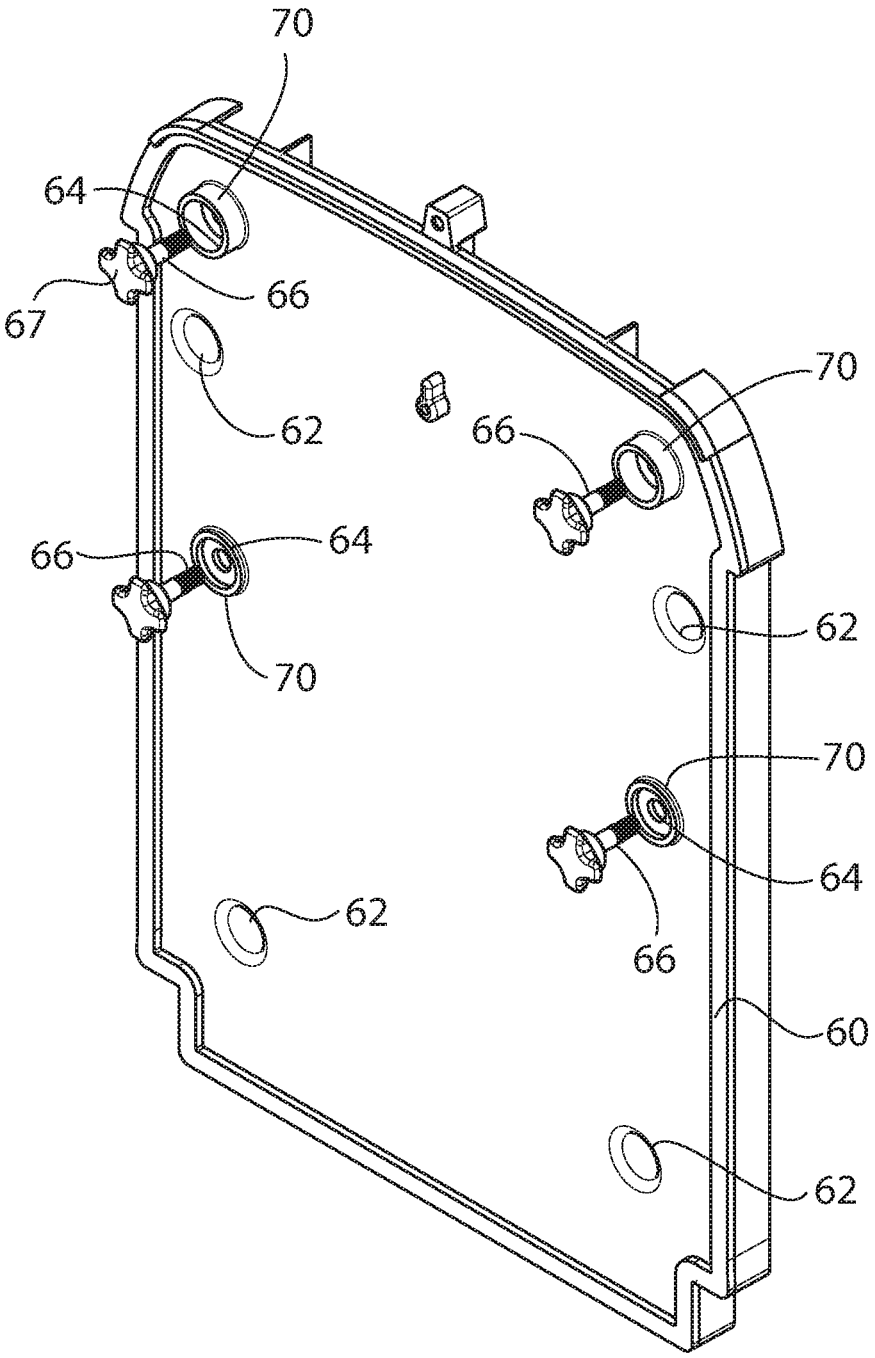
FIG. 6 is view similar to FIG. 4 of the wall mount plate of the assembly shown in FIG. 1 with a number of threaded fasteners exploded therefrom and for affixing the dispenser housing or cabinet thereto.
Figure 7:
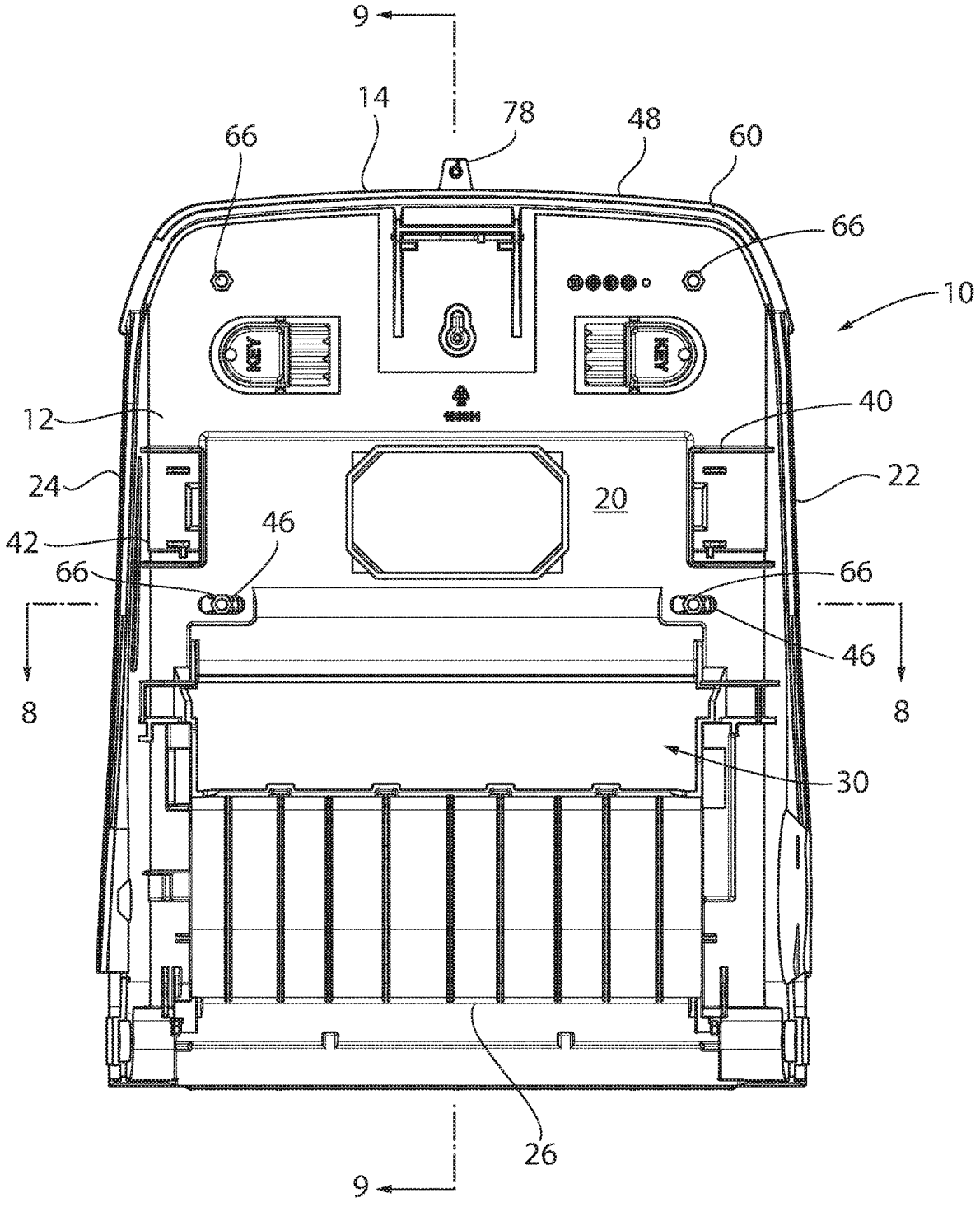
FIG. 7 is a front elevation view of the base of the water-resistant rolled web material dispenser assembly shown FIG. 3.
Figure 8:
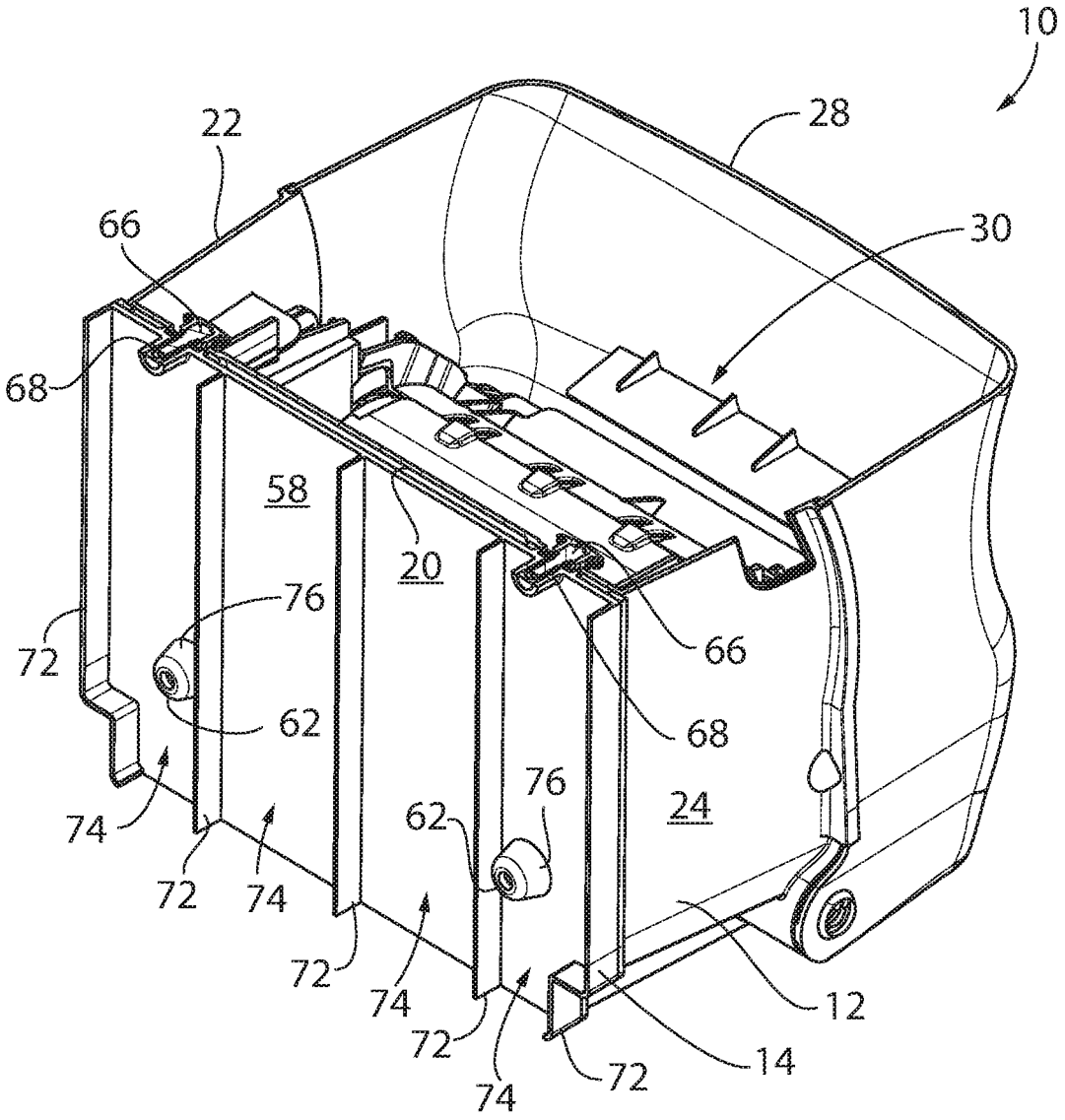
FIG. 8 is a transverse cross-section perspective view of the water-resistant dispenser assembly of FIG. 1 taken along line 8-8 shown in FIG. 7 and in which the feed mechanism has been removed from within the dispenser cabinet.

As shown in FIGS. 6-8, each of fasteners 66 may have a T-shape, a knurled or knobbed end, or other lobed handle 67 or to facilitate manual rotation or operation of the fasteners in the absence of tools, i.e. a screwdriver or other driving tool, however, other threaded fasteners are considered within the scope of the present invention. In one embodiment, the fasteners 66 may also be of a locking variety or may be used in conjunction with a locking washer (not shown) or adhesive to inhibit removal of the fasteners 66 and separation of the enclosure 18 of material dispenser assembly 12 from the mounting plate 14 of mount assembly 10, as to maintain the watertight seal formed by the gasket 60. Still referring to FIG. 4, each of enclosure securing apertures 64 may further include a raised annular ring or ridge 70 surrounding the respective apertures 64. The ridge 70 may form a secondary seal with the rear surface of the back wall 20 of the enclosure 18, during assembly, and provide an additional location of mechanical engagement between the mounting plate 14 and enclosure 18 for structurally supporting the dispenser 12 when deployed with mount assembly 10.

Referring now to FIG. 5, the rear surface 58 of mounting plate 14 is shown including a plurality of generally vertically oriented ribs 72 that extend from locations proximate the top edge 48 toward a location proximate the bottom edge 50 of the mounting plate 14. The ribs 72 extend rearwardly from the rear surface 58 of mounting plate 14 a distance of between approximately 0.5 cm and 2 cm. The adjacent ribs 72 define a plurality of vertical channels 74, such that the mounting plate 14 as shown in FIG. 5 includes five (5) ribs and four (4) vertical channels 74. Although shown as being gravitationally vertically oriented, it is appreciated that ribs 72 may be provided in other orientations. Preferably, each of ribs 72 is offset from a gravitationally horizontal orientation so that channels 74 operate to direct fluids passing therebehind in non-gravitationally horizontal directions. Preferably, ribs 72 and channels 74 extend in directions that are nearer vertical than horizontal to accommodate the desired passage and drainage of any fluids directed between mount plate 14 and the support surface.

During washdown procedures, when detergents, disinfectants, liquids, and/or water are sprayed onto the wall 16 and/or dispenser 12, liquids flowing down wall 16 are directed into channels 74 via one or more inlets 75. In so doing, the liquid will be diverted away from the seal formed by the gasket 60 between the mounting plate 14 and the back wall 20 of the enclosure 18 and is allowed to flow over a majority of the area generally behind dispenser 12 and mount assembly 10 and drains therefrom via one or more outlets 77.

As shown in FIG. 5, the rear surfaces of both the wall mounting apertures 62 and the set of enclosure securing apertures 64 are shown extending rearwardly from the rear surface 58. More specifically, the wall mounting apertures 62 are disposed within a boss or a post 76 which has a height approximately equal to that of the ribs 72, and directly contacts the wall 16 when the mounting plate 14 is affixed to the wall 16. Additionally, the enclosed rear surface of the set of enclosure securing apertures 64 as shown, in which the watertight threaded sockets are disposed. As such, each of ribs 72 and posts 76 act to provide a standoff or offset associated with the rear facing surface of mount assembly 10 and wall 16 when dispenser assembly 12 is connected thereto. Such considerations reduce instances of fluids flowing down the wall surfaces generally above the dispenser and mount assembly 10, 12 from contact with the outward facing surfaces of enclosure 18 of dispenser assembly 12 and improves the ability of mount assembly 10 and dispenser assembly 12 to maintain a watertight condition associated with deployment thereof. Further, mount assembly 10 cooperates with dispenser assembly 12 in a manner that allows more thorough cleaning, disinfectant, venting, and/or irrigating of the environment associated with deployment with of the waterproof rolled web material dispenser assembly 10, 12.

Figure 9:
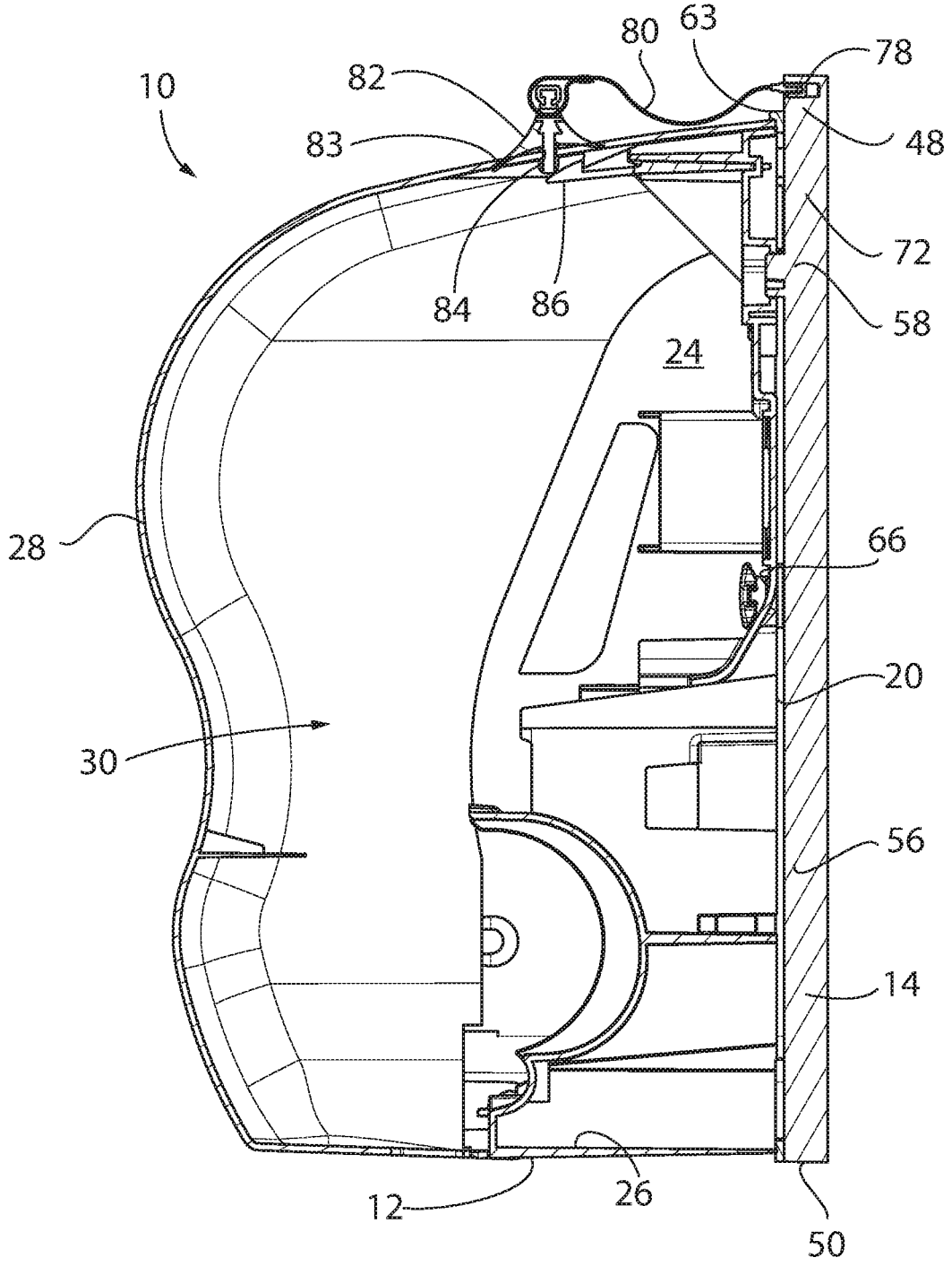
FIG. 9 is an elevational cross-sectional view of the water resistant dispenser assembly of FIG. 1 along the plane indicated by line 9-9 shown in FIG. 7, and in which the feed mechanism has been removed from the dispenser assembly.

Still referring to FIG. 5, an anchor 78 is preferably disposed proximate the top edge 48 of the mounting plate 14. As shown in FIGS. 1, 4, and 9, an optional tether 80 extends between anchor 78 and a plug 82 that is shaped to sealingly cooperate with key hole associated with enclosure 18. The key slot plug 82 is preferably a rubberized plug 82 that can be positioned within a key hole slot 84 associated with cover 28 of the enclosure 18 to form a watertight seal about the key hole slot 84. Plug 82 preferably includes a deflectable or compressible skirt 83 that generally surrounds a blade 85 that is shaped to engage slot 84. Blade 85 includes one or more catches 87 (FIG. 4) are formed at generally opposite ends thereof.

Blade 85 and catches 87 of plug 82 cooperate with slot 84 such that plug 82 snap-fittingly cooperates therewith in a manner that compresses skirt of the exposed surface of cover 28 proximate slot 84 thereby providing a sealed interface thereabout. When engaged with slot 84, the exposed upward directed surfaces of plug 84 are shaped to divert moisture or liquid in radial shedding directions away from a lower perimeter edge of plug 82 further improving the ability of plug 82 to resist infiltration of liquids associated with the interface between plug 82, cover 28, and slot 84. Plug 82 cooperates with key hole slot 84 in a manner that provides the desired sealed interaction therewith but such that plug 82 is incapable of operation of a lock mechanism 86 associated with dispenser assembly 12. Such a consideration allows plug 82 to engage dispenser assembly 12 in a sealing manner without effectuating disengagement of the closure lock mechanism 86 and thereby inadvertent or unintended opening of cover 28.

When deployed, the water-resistant mount and dispenser assembly 10 is installed in environments that are susceptible to periodic or episodic liquid exposure, such as industrial and/or commercial facilities that require periodic washdown events with fluids such as detergents, disinfectants, other liquids and/or fluids, and/or water. During installation, the mounting plate 14 is attached to the wall 16 by passing fasteners through the discrete mounting apertures 62 and securing them to the wall 16. When secured in such a manner, ribs 72 contact wall 16 and channels 74 become defined by the space between adjacent ribs 72, the rear surface 58 of the mounting plate 14, and the wall 16 and thereby accommodate the passage of liquids in a substantially downward flow direction in an area behind mount assembly 10 and in a downward direction at locations remote from rolled web material dispenser assembly 12.

Upon securement of mount plate 14 relative to wall 16, enclosure 18 of dispenser 12 can subsequently be affixed to the wall secured mounting plate 14 via passing threaded fasteners 66 through apertures 46 in the back wall 20 of the enclosure 18 and into apertures 64 defined by mount plate 14, where the threaded shafts of the discrete fasteners 66 form a fluid tight mechanical linkage with the threaded slots 68 defined by mounting plate 14. Tightening of fasteners 66 compresses the back wall 20 of the enclosure 18 of dispenser assembly 12 toward the front surface 56 of the mounting plate 14 thereby compressing gasket 60 that extends about the perimeter of the front surface 56 of the mounting plate 14 and forming a fluid tight seal therebetween. It should be further appreciated that fasteners 66 preferably cooperate with mount plate 14 and enclosure 18 such that, fasteners remain engaged with the rear wall of enclosure 18 when fasteners 66 are disengaged from mount plate 14 if it is desired to remove dispenser assembly 12 therefrom. It is appreciated that a retaining washer or push nut could be engaged with each fastener 66 after each fastener is engaged with the rear wall of enclosure 18 to limit undesired dissociation of the discrete fasteners 66 from enclosure 18 during the rotational operation of fasteners 66. Such a consideration mitigates inadvertent loss or misplacement of fasteners 66.

The roll of flexible sheet material may then be installed in the cavity 30 of the dispenser 12 and fed through the feed mechanism 32. Once the cover 28 is closed, the rubberized key slot plug 82 is associated with the key hole slot 84 defined by dispenser assembly 12 and sealing the generally upward directed surface thereof. When so configured, the water-resistant mount and dispenser assembly 10 allows the bulk roll of web material to be dispensed from the dispenser assembly in the customary manner, allows the mount and dispenser assembly to remain in place during each wash-down event while maintaining the roll of web material disposed therein in a dry condition, and in a manner that accommodates sanitation of a majority of the area disposed immediately behind the deployed assembly.

In another aspect of the present invention, mount assembly 10 is provided as a kit that includes mounting plate 14, threaded fasteners 66, optional tether 80, and rubberized plug 82. It is appreciated that mount plate 14 may be provided in various sizes and shapes that are selected to cooperate in the manner disclosed above with preexisting or previously acquired dispensers 12. Understandably, in instances where the user is not in possession of a previously acquired dispenser assembly and/or desires placement of new dispenser assembly, it is appreciated that the kit may include a dispenser assembly constructed to cooperate with the respective mount plate when deployment of the same is intended to be subjected to periodic washdown events.

Further, the invention may be implemented in a variety of configurations, using certain features or aspects of the embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter of the claims.

What is claimed is:

1. A water-resistant roll material dispenser assembly comprising:

an enclosure configured to hold a roll of web material, the enclosure having a downwardly directed opening through which web material is dispensed;

a mounting plate affixed to a back surface of the enclosure;

a gasket disposed between a front surface of the mounting plate and the back surface of the enclosure and forming a watertight seal therebetween;

a plurality of ribs extending rearwardly from a back surface of the mounting plate towards a mounting surface; and a channel formed between adjacent ones of the plurality of ribs and having an inlet near a top of the channel and an outlet near a bottom of the channel to allow fluids to pass through the channel.

2. The assembly of claim 1 wherein the plurality of ribs are generally vertically oriented.

3. The assembly of claim 2 wherein the mounting plate defines a plurality of channels between adjacent ribs and each of the plurality of channels is constructed to pass fluid therethrough.

4. The assembly of claim 3 wherein the mounting plate further comprises a plurality of watertight threaded slots that are each configured to receive a threaded fastener passing through the back surface of the enclosure.

5. The assembly of claim 4 wherein the watertight threaded slots are disposed within one or more of the plurality of channels and extend rearwardly from the back surface of the mounting plate a distance less than or equal to a depth of the ribs.

6. The assembly of claim 3 wherein the mounting plate further comprises a plurality of posts extending rearwardly from the back surface of the mounting plate a distance that is less than or equal to a depth of the ribs.

7. The assembly of claim 6 wherein each post comprises an aperture for receiving a fastener that engages the mounting surface.

8. The assembly of claim 1 wherein the gasket is disposed about a perimeter of the front surface of the mounting plate.

9. The assembly of claim 8 wherein the perimeter of the front surface of the mounting plate is approximately equal to a perimeter of the back surface of the enclosure.

10. The assembly of claim 1 further comprising a plug flexibly tethered to the mounting plate.

11. The assembly of claim 10 wherein the plug forms a watertight seal when the plug is engaged with a keyhole formed by the enclosure.

12. A kit for use with a wall mounted roll material dispenser having an enclosure configured to hold a roll of web material with an opening through which the web material is dispensed and rendering the wall mounted roll material dispenser resistant to liquid infiltration, the kit comprising:

a mounting plate constructed to be disposed between a back surface of the enclosure and a wall associated with supporting the wall mounted roll material dispenser;

a gasket disposed about a perimeter of a front surface of the mounting plate and configured to form a watertight seal with the back surface of the enclosure;

a plurality of ribs extending rearwardly from the back surface of the mounting plate toward the wall; and an annular ring that extends in a forward direction from the front surface of the mounting plate such that the annular ring is located about each of a plurality of watertight threaded slots defined by the mounting plate; and wherein the mounting plate further comprises a plurality of posts extending rearwardly from the back surface of the mounting plate a distance less than or equal to a depth of the ribs, and wherein each post comprises an aperture for receiving a fastener that engages the wall therein.

13. The kit of claim 12 further comprising a plug that is tethered to the mounting plate and configured to form a watertight seal with a keyhole disposed within an outer surface of the enclosure.

14. The kit of claim 12 further comprising a plurality of threaded fasteners configured to pass through the back surface of the enclosure and operative end of the mounting plate to secure the mounting plate to the back surface of the enclosure.

15. The kit of claim 12 further comprising a channel formed between adjacent ones of the plurality of ribs and having an open top and an open bottom to accommodate passage of fluid through the channel.

16. The kit of claim 12 wherein the mounting plate further comprises a plurality of posts extending rearwardly from the back surface of the mounting plate a distance less than or equal to a depth of the ribs, and wherein each post comprises an aperture for receiving a fastener that engages the wall therein.

17. A method of installing a water resistant roll material dispenser assembly, the method comprising:

acquiring a mounting plate having a front surface having a gasket disposed thereon and an opposing rear surface that defines at least one channel within a perimeter of the mounting plate affixing the mounting plate to a vertical wall such that the at least one channel is non-horizontally oriented and a portion of the opposing rear surface of the mounting plate is offset from the vertical wall;

affixing a back wall of an enclosure of a rolled web material dispenser to the mounting plate so an outward facing surface of the back wall of the enclosure engages the front surface of the mounting plate and the gasket forms a watertight seal between the back wall of the dispenser and the front surface of the mounting plate;

engaging at least one fastener through the back wall of the dispenser and into the mounting plate to compress the gasket; and engaging a plug with a keyhole defined by the enclosure to seal the keyhole.

18. The method of claim 17 further comprising forming the at least one channel to have an open top and an open bottom.

19. The method of claim 17 further comprising tethering the plug to the mounting plate.

* * * * *